United States Patent [19]

Mori et al.

[11] Patent Number: 4,565,295

[45] Date of Patent: Jan. 21, 1986

[54] PLASTIC CONTAINER CLOSURE HAVING PILFERPROOF CHARACTERISTICS

[75] Inventors: Fumio Mori, Yokohama; Junichi Itsubo, Hiratsuka; Isao Ichinose, Hiratsuka; Katsuake Tanaka, Hiratsuka; Osamu Ishii, Chigasaki; Takashi Yazaki, Hiratsuka, all of Japan

[73] Assignee: Japan Crown Cork Co Ltd., Tokyo, Japan

[21] Appl. No.: 681,480

[22] Filed: Dec. 14, 1984

[30] Foreign Application Priority Data

Jul. 6, 1984 [JP] Japan ..... 59-138904

[51] Int. Cl.[4] ..... B65D 41/34

[52] U.S. Cl. ..... 215/252

[58] Field of Search ..... 215/252

[56] References Cited

U.S. PATENT DOCUMENTS 4,497,765 2/1985 Wilde et al. ..... 215/252 X

*Primary Examiner*—Donald F. Norton

*Attorney, Agent, or Firm*—Beveridge, DeGrandi & Weilacher

[57] ABSTRACT

A pilferproof plastic closure comprising a top panel wall and a cylindrical skirt wall extending downwardly from the peripheral edge of the top panel wall. A circumferential weakening line extending circumferentially is formed in the skirt wall, and the skirt wall is divided into a main portion above the weakening line and a pilferproof bottom portion beneath it. An internal thread to be screwably fitted with an external thread formed on the mouth-neck portion of a container is formed on the inner surface of the main portion, and a plurality of radially inwardly projecting and circumferentially spaced engaging flaps are formed on the inner surface of the pilferproof bottom portion. An axial breaking line is formed in the pilferproof bottom portion which extends downwardly from the upper end of the pilferproof bottom portion but is non-existent in at least a greater portion of the lower part of the pilferproof bottom portion. At least a greater portion of the base edge of each of the engaging flaps is positioned in the aforesaid lower part where the axial breaking line does not exist.

6 Claims, 5 Drawing Figures

PLASTIC CONTAINER CLOSURE HAVING PILFERPROOF CHARACTERISTICS

FIELD OF THE INVENTION

This invention relates to a plastic container closure, and more specifically, to a pilferproof plastic closure for use in containers with a mouth-neck portion having an external thread formed on its peripheral surface and an engaging jaw portion beneath the external thread.

DESCRIPTION OF THE PRIOR ART

As pilferproof closures for containers such as bottles for holding foods and drinks, plastic closures have recently been proposed and come into commercial acceptance in place of metallic closures. A typical example of such a plastic container closure is the closure disclosed in the specification of Japenese Laid-Open Patent Publication No. 74445/1981. This closure has a top panel wall and a cylindrical skirt wall extending downwardly from the peripheral edge of the top panel wall. Formed on the skirt wall is a circumferential weakening line composed of a plurality of circumferentially extending slits spaced from each other in the circumferential direction and a plurality of bridging portions positioned among the circumferential slits. The skirt wall is thus divided into a main portion located above the weakening line and a pilferproof bottom portion located beneath the weakening line. An internal thread is formed on the inner surface of the main portion, and a plurality of circumferentially spaced and radially inwardly projecting engaging flaps are formed on the inner surface of the pilferproof bottom portion.

The above-described plastic closure is applied to a container including a mouth-neck portion having an external thread formed on its peripheral surface and an engaging jaw portion located beneath the external thread. To close the mouth-neck portion of the container by the closure, the closure is put over the mouth-neck portion and turned in a predetermined closing direction to fit the internal thread of the closure screwably with the external thread of the mouth-neck portion. Thus, the closure is turned in the closing direction and at the same time moves axially downwardly with respect to the mouth-neck portion. Consequently, the engaging flaps of the closure go beyond the engaging jaw portion of the mouth-neck portion and engage its undersurface. To open the mouth-neck portion of the container, the closure is turned in an opening direction which is ipposite to the closing direction. Thus, the internal thread of the closure is moved along the external thread of the mouth-neck portion, and threfore, the closure is turned in the opening direction and simultaneously moves axially upwardly. However, the pilferproof bottom portion cannot move axially upwardly because the engaging flaps formed on its inner surface are held in engagement with the undersurface of the engaging jaw portion of the mouth-neck portion. As a result, a considerable stress is generated on the bridging portions of the circumferential weakening line formed on the skirt wall of the closure, and finally the bridging portions are broken to separate the skirt wall into the main portion and the pilferproof bottom portion. Thereafter, the top panel wall and the main portion of the skirt wall are removed from the mouth-neck portion. The mouth-neck portion is thus opened, and the pilferproof bottom portion remains attached to the mouth-neck portion.

If the pilferproof bottom portion remains attached to the mouth-neck portion, it must be removed when the container is to be used again. This removing operation, however, is considerably complex. Moreover, when the pilferproof bottom portion remains in the mouth-neck portion and the top panel wall and the main portion of the closure which have once been removed are again mounted on the mouth-neck portion, it is not rare that the bridging portion of the closure which has been broken at the time of opening the mouth-neck portion looks as if it were not broken, and the pilferproof characteristics of the closure are not sufficiently evident. For these reasons, it is often desired in plastic closures as is realized in metallic closures to remove the pilferproof bottom portion also together with the other portions of the closure at the time of opening the mouth-neck portion. To achieve this desire, it is necessary as in the case of the metallic closures to make the strength of at least one bridging portion higher than the other bridging portions and form a breaking line axially in the pilferproof bottom portion. When this structure is employed, the axial breaking line is broken at the time of opening the mouth-neck portion and the pilferproof bottom portion is opened in a tape form. In the meantime, the bridging portion having a higher strength is retained without breakage. Accordingly, the pilferproof bottom portion opened in a tape form remains attached to the main portion of the skirt wall by the higher strength bridging portion and the pilferproof bottom portion is also removed from the mouth-neck portion together with the other portions of the closure.

In the production of plastic container closures which meet the above requirement, the following problem to be solved exists with regard to the formation of an axial breaking line in the pilferproof bottom portion.

The axial breaking line is formed of a so-called perforation or score as in the case of metallic closures. It is desired in this case to provide the axial breaking line simultaneously with, or separately from, the provision of the circumferential slits in the circumferential weakening line after forming a closure blank by injection molding, compression molding, etc. as is the case with the metallic closures. To provide the perforation or score on the pilferproof bottom portion, it is necessary to apply cutting tools to the pilferproof bottom portion from both its outside and inside surfaces. There will be no particular problem if the actuating projecting portion of an inside cutting tool to be applied from the inside surface of the pilferproof bottom portion is smaller than the circumferential distance between the adjoining engaging flaps and is properly positioned between the engaging flaps. In actual production, however, it is impossible or extremely difficult to position the actuating projecting portion of the inside cutting tool between the engaging flaps because it causes a drastic decrease in the speed of production. If the actuating projecting portion of the inside cutting tool is not positioned between the engaging flaps but at least partly overlaps the engaging flaps, it will be readily understood that the actuating projecting portion of the inside cutting tool exerts a great pressing force on the engaging flaps and consequently a great degree of deformation is undesirably generated on the engaging flaps.

SUMMARY OF THE INVENTION

It is a primary object of this invention to provide a novel and improved plastic container closure which, without involving the aforesaid problem, can meet the requirement that the pilferproof bottom portion is surely broken axially and opened in tape form at the time of container opening.

Other objects of this invention will become apparent from the following description of one embodiment of the present invention.

The present inventors have conducted extensive investigations and experiments not only on pilferproof plastic closures but also on a process for manufacturing them, and have found that (i) if an axial breaking line which may be a slit or score is formed on the pilferproof bottom portion extending from its upper end to the upper end of its lower part or to a point somewhat below it, the lower part of the pilferproof bottom portion is axially broken following the axial breaking line at the time of container opening and the pilferproof bottom portion is opened in tape form without any particular need to form a slit or score in at least a greater portion of the lower part of the pilferproof bottom portion; and (ii) if at least a greater portion of the base edge of each of the engaging flaps is positioned in the lower part of the pilferproof bottom portion in which the axial breaking line does not exist, the above axial breaking line can be formed without causing a drastic decrease in the speed of production and without a likelihood of greatly deforming the engaging flaps. This discovery has led to the achievement of the aforesaid object of the invention.

According to this invention, there is provided a pilferproof plastic closure for a container including a mouth-neck portion having an external thread formed on its peripheral surface and an engaging jaw portion located beneath the external thread, said closure comprising a top panel wall and a cylindrical skirt wall extending downwardly from the peripheral edge of the top panel wall, said skirt wall having a circumferentially extending weakening line formed therein and being divided into a main portion above the circumferential weakening line and a pilferproof bottom portion beneath the circumferential weakening line, said main portion having formed on its inner surface an internal thread to be screwably fitted with the external thread of the mouth-neck portion of the container and said pilferproof bottom portion having formed on its inner surface a plurality of radially inwardly projecting and circumferentially spaced engaging flaps; wherein an exial breaking line is formed in the pilferproof bottom portion extending downwardly from the upper end of the pilferproof bottom portion but being non-existent in at least a greater portion of the lower part of the pilferproof bottom portion, and at least a greater portion of the base edge of each of the engaging flaps is positioned in said lower part of the pilferproof bottom portion in which the axial breaking line does not exist.

DETAILED DESCRIPTION OF PREFERRED EMBODIMENTS

The invention will be described in greater detail with reference to the accompanying drawings.

Figure 1:
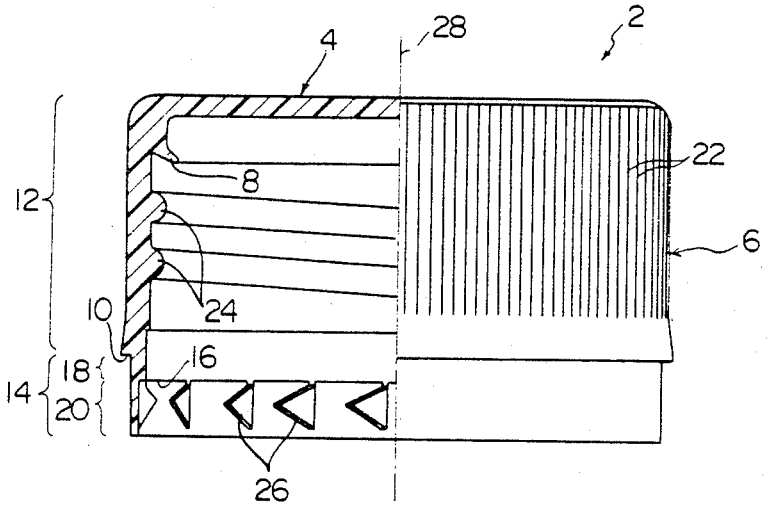
FIG. 1 is a side elevation showing, partly in section, a blank to be formed into one embodiment of the closure constructed in accordance with this invention.

FIG. 1 shows a closure blank to be processed into one embodiment of the closure constructed in accordance with this invention. The blank shown generally at 2, which is formed from a suitable plastic material such as polypropylene or polyethylene by injection molding, compression molding, etc., has a circular top panel wall 4 and a cylindrical skirt wall 6 extending downwardly from the peripheral edge of the top panel wall 4. An annular projection 8 is formed on the inside surface of the top panel wall 4. In the lower part of the peripheral surface of the skirt wall 6 is formed a step portion 10 displaced diametrically inwardly. A portion 12 above the step portion 10 has a considerable wall thickness, whereas the thickness of a portion 14 below the step portion 10 is decreased. In the illustrated embodiment, a step portion 16 is formed also on the inner circumferential surface of the skirt wall 6 below the step portion 10, and the portion 14 has a relatively thick portion 18 above the step portion 16 and a relatively thin portion 20 below the step portion 16. As will be clear from a description given hereinbelow, the thickness $t_1$ of the portion 20 is sufficiently small, and preferably 0.05 to 0.75 mm, especially 0.20 to 0.50 mm. The thickness $t_2$ of the relatively thick portion 18 is conveniently 0.50 to 1.10 mm, especially 0.75 to 0.85 mm. If desired, the thickness $t_2$ of the portion 18 can be made sufficiently small as in the portion 20 (therefore, the step portion 16 does not exist). A raised and depressed or knurled portion 22 is formed on the peripheral surface of the portion 12 of the skirt wall 6 in order to prevent slippage of a finger which engages it. An internal thread 24 is formed on the inner circumferential surface of the portion 12 of the skirt wall 6. A plurality of circumferentially spaced engaging flaps 26 are formed on the inner circumferential surface of the portion 14 of the skirt wall 6. Each of the engaging flaps 26 is projected radially inwardly from its base edge connected to the inner circumferential surface of the portion 14. As shown in the drawing, the base edge of each of the engaging flaps 26 extends substantially parallel, or somewhat inclinedly to, an axis 28, and each of the flaps 26 may be of a nearly triangular shape extending radially inwardly from the base edge without inclimation or with an inclination to either side in the circumferential direction. As will be clear from a description given hereinbelow, it is important that at least a greater portion of the base edge of each of the engaging flaps 26 be positioned in the relatively thin portion 20 below the step portion 16 in the portion 14. In the illustrated embodiment, the upper end of the base edge of each of the engaging flaps 26 is positioned in alignment with the step portion 16. Hence, the entire base edge of each of the engaging flaps 26 is positioned in the relatively thin portion 20 below the step portion 16.

Figure 2:
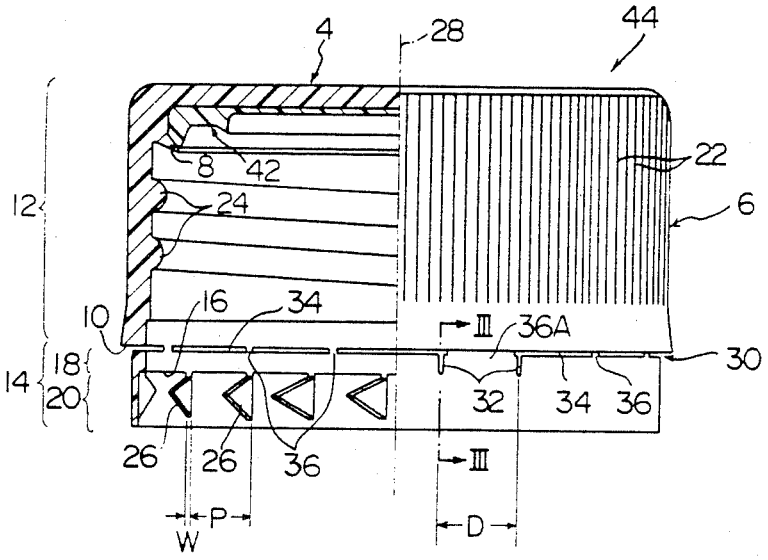
FIG. 2 is a side elevation showing, partly in section, one embodiment of the closure constructed in accordance with this invention.

With reference to FIG. 2 together with FIG. 1, to produce the container closure of this invention, a circumferential weakening line 30 is formed in the bland 2, and preferably simultaneously with the provision of the circumferential weakening line 30, axial breaking line 32 are formed in the blank 2. As shown in FIG. 2, the circumferential weakening line 30 is disposed immediately below the step portion 10, and therefore, the portion 12 having a considerable thickness located above the step portion 10 constitutes a main portion of the skirt wall 6, and the portion having a decreased thickness below the step portion 10 composed of the relatively thick portion 18 and the relative thin portion 20 constitutes a pilferproof bottom portion. The circumferential weakening line 30 itself is comprised of a plurality of circumferentially spaced and circumferentially extending slits 34 and a plurality of bridging portions 36 located among the slits 34. The portion 14, i.e. the pilferproof bottom portion 14, is connected to the portion 12, i.e. the main portion 12 of the skirt wall 6, via the bridging portions 36. One bridging portion 36A among the plurality of bridging portions 36 is formed as a high strength bridging portion which has a larger circumferential length than the other bridging portions 36 and higher strength than the others. If desired, two or more of them may be formed as high strength bridging portions.

Figure 3:
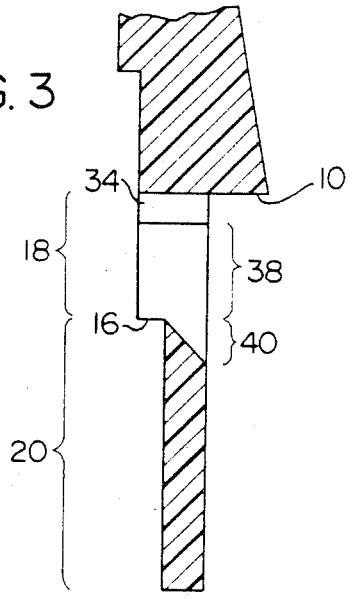
FIG. 3 is a sectional view taken along line III—III of FIG. 2.

In the illustrated embodiments, two axial breaking lines 32 are provided circumferentially at predetermined intervals (the intervals will be described further hereinafter), although the number of such axial breaking lines may be 1 or 3 or more. One of the axial breaking lines 32 is disposed adjacent to one end of the high strength bridging portion 36A as viewed circumferentially, and the other, adjacent to the other end of the high strength bridging portion 36A as viewed circumferentially. It is critical that the axial breaking lines 32 extend downwardly from the upper end of the pilferproof bottom portion 14, but terminate at the upper end (therefore, the step portion 16) of the relatively thin portion 20 of the pilferproof bottom portion 14 or at a point slightly below it, and that they do not exist at least in a greater portion of the relatively thin portion 20. The axial breaking lines 32 may extend substantially parallel to the axis 28, or with a slight inclination to the axis 28, as shown in the drawing. The axial breaking lines 32 themselves may be formed of a slit made by completely cutting a material, or of a score or a perforation made by partly cutting the material in the thickness direction. With reference to FIG. 3 together with FIG. 2, each of the illustrated axial breaking lines 32 is comprised of a slit 38 extending from the upper end of the pilferproof bottom portion 14 to the step portion 16 (therefore, along the entire portion 18 of the pilferproof bottom portion 14) and a score 40 following the slit 38 and extending downwardly over some distance (therefore, along the relatively thin portion 20 of the pilferproof bottom portion 14). In the score 40, the cut depth of the material is progressively decreased as it extends downwardly. Accordingly, the thickness of the remaining material is progressively increased as it extends downwardly.

With regard to the axial breaking lines 32, the following fact should be noted. In forming the axial cutting line 32, more specifically the slit 38 and the score 40, simultaneously with or separately from the formation of the circumferential weakening line 30, more specifically the slit 34, it is generally necessary to apply an outside cutting tool having cutting blades corresponding to the slit 34 and the slits 38 and 40 formed at its peripheral edge to the blank 2 from its peripheral surface and at the same time, apply an inside cutting tool having actuating projecting portions cooperating with the cutting blades to it from its inner circumferential surface. The axial breaking line 32, however, terminates at the upper end of the relatively thick portion 20 of the pilferproof bottom portion 14 or at a point slightly below it and does not exist in at least a greater portion of the relatively thin portion 20. Hence, it is not at all necessary to apply the actuating projecting portion of the inside cutting tool to at least a greater portion of the relatively thin portion 20. In addition, at least a greater portion of the base edge of each of the engaging flaps 26 is positioned in the relatively thin portion 20. Accordingly, the axial breaking line 32 can be formed without the need for an operation of setting the angular relation between the blank 2 and the inside cutting tool at a predetermined one, which is complex and cause a drastic decrease in efficiency. Furthermore, this can be achieved while surely avoiding the deformation of the engaging flaps 26 by the great pressing force of the actuating projecting portion of the inside cutting tool.

The following fact should also be noted with regard to the formation of the axial breaking line 32. When the angular relation between the blank and the outside and inside cutting tools is set at a predetermined one in providing the axial breaking lines 32, the efficiency will be drastically reduced as stated hereinabove. Accordingly, it is desired to perform the cutting operation without particularly setting the aforesaid angular relation. When the cutting operation is performed without particularly setting the aforesaid angular relation, the axial breaking line 32 is formed at an arbitrary angular position. As will be understood from a description given hereinafter, in opening the closure, the relatively thin portion 20 of the pilferproof bottom portion 14 should be broken following the axial breaking line 32. When the axial breaking line 32 is formed at an angular position at which it is aligned with, or overlaps, the base edge of the engaging flap 26, the breaking of the relatively thin portion 20 becomes considerably difficult owing to the presence of the engaging flap 26. In view of this fact, the engaging flaps 26 are arranged circumferentially at equal intervals in the illustrated embodiment, and moreover, the circumferential distance D of the two axial breaking lines 32 is set as follows with respect to the circumferential pitch P of the engaging flap 26 and the circumferential width W of the base edge of the engaging flap 26.

$$(n+1)P-W>D>nP+W$$

where n is 0 or a positive integer.

Under these conditions, at least one of the two axial breaking lines 32 is at an angular position at which it is not aligned with, or does not overlap, the base edge of the engaging flap 26. Accordingly, at the time of opening the closure, the relatively thin portion 20 of the pilferproof bottom portion 14 can be surely and easily broken following the breaking of at least one of the two axial breaking lines 32.

Again, with reference to FIG. 2, a sealing liner 42 of a suitable plastic material may be formed on the inside surface of the top panel wall 4 of the blank 2, or more specifically on the annular projection 8 formed on the inside surface of the top panel wall 4, after or before the provision of the circumferential weakening line 30 and the axial breaking lines 32. The formation of the sealing liner 42 can be effected by a molding method known per se. Instead of forming the sealing liner 42 separately, a sealing protrusion of a suitable shape may be integrally formed on the inner surface of the top panel wall 4 of the blank 2.

Figure 4:
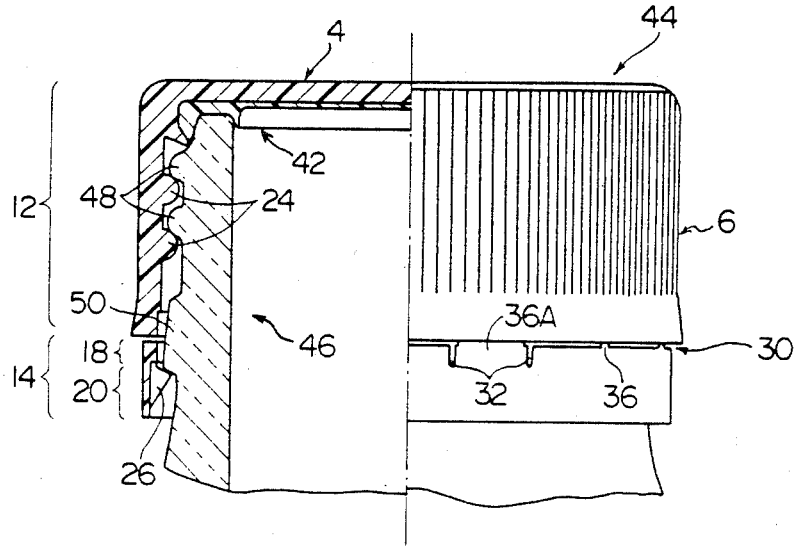
FIG. 4 is a side elevation showing, partly in section, the closure of FIG. 2 as it is mounted on the mouth-neck portion of a container.

The finished closure 44 so formed is applied to a container having a mouth-neck portion 46 of the form indicated in FIG. 4. On the culindrical peripheral surface of the mouth-neck portion 46, an external thread 48 and an engaging jaw portion 50 beneath it are formed.

To close the mouth-neck portion 46 by the closure 44, the closure 44 is put over the mouth-neck portion 46 and turned in the closing direction, i.e. clockwise as viewed from above in FIG. 4. Thus, the internal thread 24 of the closure 44 is screwably fitted with the external thread 48 of the mouth neck portion 46. As a result, the closure 44 moves axially downwardly as it is turned. When the internal thread 24 is fully fitted with the external thread 48, the engaging flaps 26 of the closure 44 go beyond the engaging jaw portion 50 of the mouth-neck portion 46 and engages the undersurface of the engaging jaw portion 50. Furthermore, the sealing liner 42 of the closure 44 is pressed by the top surface portion of the mouth-neck portion 46 and the mouth-neck portion 46 is sealed.

Figure 5:
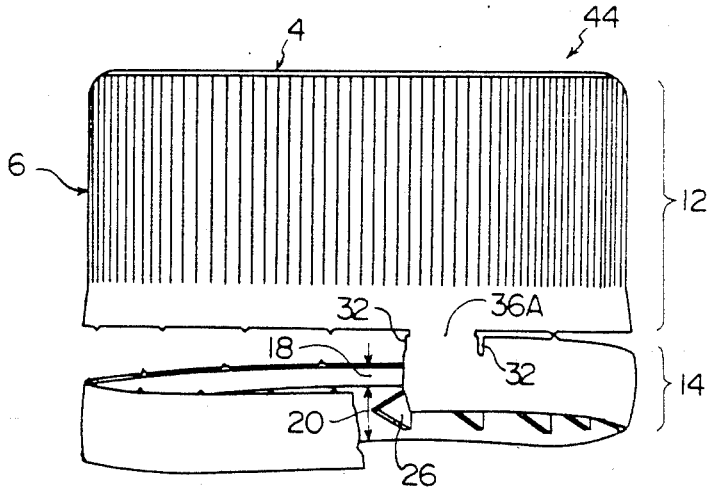
FIG. 5 is a side elevation showing the closure of FIG. 2 as it is detached from the mouth-neck portion of a container after it has been once mounted on it.

To open the mouth-neck portion 46, the closure 44 is turned in the opening direction, i.e. counterclockwise as viewed from above in FIG. 4. Thus, the internal thread 24 of the closure 44 moves along the external thread 48 of the mouth-neck portion 46, and therefore, the closure 44 moves axially upwardly as it is turned. The pilferproof bottom portion 14, however, cannot move axially upwardly since the engaging flaps 26 formed on its inner surface are engaged with the undersurface of the engaging jaw portion 50 of the mouth-neck portion 46. Consequently, a considerable stress is generated on the circumferential weakening line 30, and more specifically on its bridging portions 36. The bridging portions 36 of the circumferential weakening line 30 are therefore broken while leaving the high strength bridging portion 36A as shown in FIG. 5. Furthermore, as shown in FIG. 5, the relatively thin portion 20 of the pilferproof bottom portion 14 is broken following the breaking of at least one of the two axial breaking lines 32. As a result, the pilferproof bottom portion 14 is opened in tape form, and the engaging flaps 26 are disengaged from the undersurface of the engaging jaw portion 50. With regard to the breakage of the relatively thin portion 20, it has been experimentally determined that if the thickness $t_1$ of the portion 20 is sufficiently thin and preferably 0.05 to 0.75 mm, especially 0.20 to 0.50 mm, the portion 20 is surely broken following the axial breaking lines 32 without the need to form a score or the like. After the pilferproof bottom portion 14 has been opened in tape form and the engaging flaps 26 have come out of engagement with the undersurface of the engaging jaw portion 50, the entire closure 44 including the pilferproof bottom portion 14 linked to the main portion 12 by the high strength briding portion 36A remaining unbroken is moved axially upwardly as it is turned. As a result, the entire closure 44 is removed from the mouth-neck portion 46 and the mouth-neck portion 46 is opened.

While the present invention has been described in detail hereinabove with reference to one embodiment of the closure constructed in accordance with this invention and shown in the accompanying drawings, it should be understood that the invention is not limited to this specific embodiment and various changes and modifications are possible without departing from the scope of this invention.

We claim:

1. A pilferproof plastic closure for a container including a mouth-neck portion having an external thread formed on its peripheral surface and an engaging jaw portion located beneath the external thread, said closure comprising a top panel wall and a cylindrical skirt wall extending downwardly from the peripheral edge of the top panel wall, said skirt wall having a circumferentially extending weakening line formed therein and being divided into a main portion above the circumferential weakening line and a pilferproof bottom portion beneath the circumferential weakening line, said main portion having formed on its inner surface an internal thread to be screwably fitted with the external thread of the mouth-neck portion of the container and said pilferproof bottom portion having formed on its inner surface a plurality of radially inwardly projecting and circumferentially spaced engaging flaps, wherein each of said flaps has a base edge; wherein an axial breaking line is formed in the pilferproof bottom portion extending downwardly from the upper end of the pilferproof bottom portion but being non-existent in at least a greater portion of the lower part of the pilferproof bottom portion, and at least a greater portion of the base edge of each of the engaging flaps is positioned in said lower part of the pilferproof bottom portion in which the axial breaking line does not exist.

2. The closure of claim 1 wherein the upper part of the pilferproof bottom portion has a relatively large thickness, and its lower part has a relatively small thickness, and the axial breaking line extends to the lower end of said upper part or to a point slightly below it.

3. The closure of claim 1 wherein the axial breaking line is a slit or score, and at its lower end portion, the thickness of the remaining material is progressively increased as it extends downwardly.

4. The closure of claim 2 wherein the relatively thin lower part of the pilferproof bottom portion has a thickness $t_1$ of 0.05 to 0.75 mm.

5. The closure of claim 4 wherein the thickness $t_1$ is 0.20 to 0.50 mm.

6. The closure of claim 1 wherein the circumferential weakening line is comprised of a plurality of circumferentially spaced and circumferentially extending slits and a plurality of bridging portions located among the circumferential slits; at least one of the bridging portions is a high strength bridging portion having higher strength than the other bridging portions; and the axial breaking line is located adjacent to the circumferential end of the high strength bridging portion as viewed circumferentially.

* * * * *